US006783800B2

(12) United States Patent
Saito et al.

(10) Patent No.: US 6,783,800 B2
(45) Date of Patent: Aug. 31, 2004

(54) MANUFACTURING METHODS OF WATER REPELLENT MEMBER AND INKJET HEAD

(75) Inventors: Yasuyuki Saito, Kanagawa (JP); Junri Ishikura, Tokyo (JP); Kazuhiro Aoyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 10/365,464

(22) Filed: Feb. 13, 2003

(65) Prior Publication Data

US 2003/0157255 A1 Aug. 21, 2003

(30) Foreign Application Priority Data

Feb. 15, 2002 (JP) ..... 2002-039023
Jan. 31, 2003 (JP) ..... 2003-024702

(51) Int. Cl.[7] ..... B05D 1/36

(52) U.S. Cl. ..... 427/201; 427/180; 427/255.25; 427/255.3; 427/421; 427/427

(58) Field of Search ..... 427/201, 180, 427/255.25, 255.3, 421, 427

(56) References Cited

U.S. PATENT DOCUMENTS 5,204,088 A * 4/1993 Noebel et al. ..... 424/47
5,284,707 A 2/1994 Ogawa et al. ..... 428/447
5,324,566 A 6/1994 Ogawa et al. ..... 428/141
5,380,585 A 1/1995 Ogawa et al. ..... 428/333
5,407,709 A 4/1995 Ogawa et al. ..... 427/539
5,437,894 A 8/1995 Ogawa et al. ..... 427/535
5,466,486 A 11/1995 Ogawa et al. ..... 427/352
5,580,605 A 12/1996 Ogawa et al. ..... 427/155
5,589,271 A 12/1996 Watanabe et al. ..... 428/421
6,045,867 A 4/2000 Watanabe et al. ..... 427/377
6,503,567 B2 1/2003 Ogawa et al. ..... 427/341

FOREIGN PATENT DOCUMENTS

JP 3-153859 7/1991
JP 4-239633 8/1992
JP 4-283268 10/1992

* cited by examiner

*Primary Examiner*—Bernard Pianalto
(74) *Attorney, Agent, or Firm*—Fitzpatrick, Cella, Harper & Scinto

(57) ABSTRACT

A method for manufacturing an inkjet head having orifice plates with improved ink-repellent properties and durability, including the step of forming the ink-repellent film on the surface of the substrate by using the gas deposition process is provided.

16 Claims, 9 Drawing Sheets

MANUFACTURING METHODS OF WATER REPELLENT MEMBER AND INKJET HEAD

BACKGROUND OF THE INVENTION

1. Field of the Invention

The present invention relates to a method for manufacturing a water repellent member in which the surface of a substrate made of glass, ceramics, plastic, metal, or the like is covered with a film having water repellent properties, and also relates to a method for manufacturing an inkjet head.

2. Related Background Art

Heretofore, various kinds of water repellent preparations and methods have been developed and used for providing various products such as industrial equipments and electronic equipments with water repellencies, weather resistances, antifouling property, and so on.

In order to keep such surface characteristics, the following three methods have been used.

A first method is one by which the surface of a substrate made of glass, plastic, metal, or the like is roughened by blasting or etching, treated with a primer or the like, and coated with a paint containing fluorine-contained resin such as polytetrafluoroethylene (PTFE), followed by baking at a temperature of 350 to 400° C. after drying to apply the fluorine-contained resin on the surface of the substrate.

A second method is one comprising the step of forming a fluororesin such as polytetrafluoroethylene (PTFE) or tetrafluoroethylene-hexafluoropropylene copolymer on a substrate made of glass, plastic, metal, or the like by a vacuum evaporation method, a spattering method, or the like.

A third method is one that forms a water repellent metallic compound material obtained by dispersing polytetrafluoroethylene oligomer having a molecular weight of about 8000 to 10000 in a plating solution and then co-depositing the oligomer on a plated film as disclosed in JP-A-4-283268.

In each of these methods, a high water repellent substance is coated on the surface of a substrate to provide the substrate with surface properties such as water repellent properties. However, it is also known that the water repellent properties are not only depended on the water repellent properties of the coating material but also depending on the surface condition of the substrate.

Therefore, for attaining higher water repellent properties, an attempt has been made to increase an apparent surface area of the water repellent surface more than the actual surface area thereof by forming minute raised portions on the water repellent surface.

In JP-A-4-239633, for example, there is disclosed a method of forming a water repellent film having a rough surface by chemically bonding between a layer having microscopic asperities prepared by blending fine particles with silicate glass particles and a polymer film layer having a fluorocarbon group and a siloxane group by a siloxane bond.

However, the resulting fluororesin coating film has a poor resistance to scuffling in spite of having excellent water repellent properties, so that it cannot be used as a hard coating film.

For solving such a problem, JP-A-3-153859 discloses a coating film as a water repellent film having the resistance to scuffling. The coating film comprises an undercoating layer made of a metal oxide formed on a plastic substrate and a layer of a mixture of a metal oxide and a fluororesin formed on the undercoating layer.

In JP-A-3-153859, such a coating film is formed by the process vacuum deposition of a metal oxide as an undercoating layer on a plastic substrate and the process of spattering using a target comprised of the metal oxide and a fluororesin to form a coating film provided as a mixed layer of the metal oxide and the fluorocarbon.

However, the conventional technologies described above have the following disadvantages.

In the conventional first method, there is a need to prepare a paint including particles that contain a fluororesin such as polytetrafluoroethylene (PTFE). In addition, the process has to include steps of coating, drying, and baking. Consequently, the process becomes complicated.

The third method prepares a water repellent metallic compound material obtained by dispersing polytetrafluoroethylene oligomer having a molecular weight of about 8000 to 10000 in a plating solution and then co-depositing the oligomer on a plated film. In this method, however, there is a need to disperse the polytetrafluoroethylene oligomer in the plating solution.

Therefore, the third method has a limited selection of raw materials.

In each of the conventional first, second, and third methods, furthermore, the coating film is covered with a single fluororesin layer, so that it has an excellent water repellent property but poor in the resistance to scuffing.

For obtaining a coating film having an excellent resistance to scuffing, as described above, there is a method in which a metal oxide layer is provided as an undercoating layer on a substrate and a layer of a mixture of a metal oxide and a fluororesin is formed on the undercoating layer. In this method, at the time of forming the coating layer from the mixed layer of the metal oxide and the fluororesin by the sputtering method using a target comprised of the metal oxide and the fluororesin, for sputtering the fluororesin and the metal oxide with the same amount of the charged electric power, in general, the sputtering of the fluororesin having a film-forming rate compared with that of the metal oxide is selectively performed. Therefore, it is difficult to control the composition of the mixed layer (the contents of the metal oxide and the fluororesin in the coating film) is difficult, so that the water repellent properties and the resistance to scuffing are hardly rose to a desired level.

Therefore, it has been desired to provide a method for easily forming a coating film having water repellent properties and resistance to scuffing in excess of a certain level.

SUMMARY OF THE INVENTION

An object of the present invention is to provide a method for manufacturing a water repellent member covered with a water repellent film having an excellent water repellent property and an excellent durability, where such a water repellent film is formed on only a desired surface by a simple process without including complicated steps of masking and so on and also without restricting on the selection of raw materials.

Another object of the present invention is to provide a method for manufacturing an inkjet head having orifice plates with improved ink-repellent properties.

A first aspect of the present invention is a method for manufacturing a water repellent member having a substrate and a water repellent film covering the surface of the substrate, comprising the steps of: transporting particles of a water repellent material with a gas; and discharging the transported particles from a nozzle to the substrate to form the water repellent film on the surface of the substrate.

A second aspect of the present invention is a method for manufacturing an inkjet head equipped with an orifice plate having a ink-repellent surface, wherein the formation of the orifice plate includes the steps of: transporting particles of a ink-repellent material with a gas; and discharging the transported particles from a nozzle to the substrate to form the ink-repellent film on the surface of the substrate.

DETAILED DESCRIPTION OF THE PREFERRED EMBODIMENTS

Figure 1:
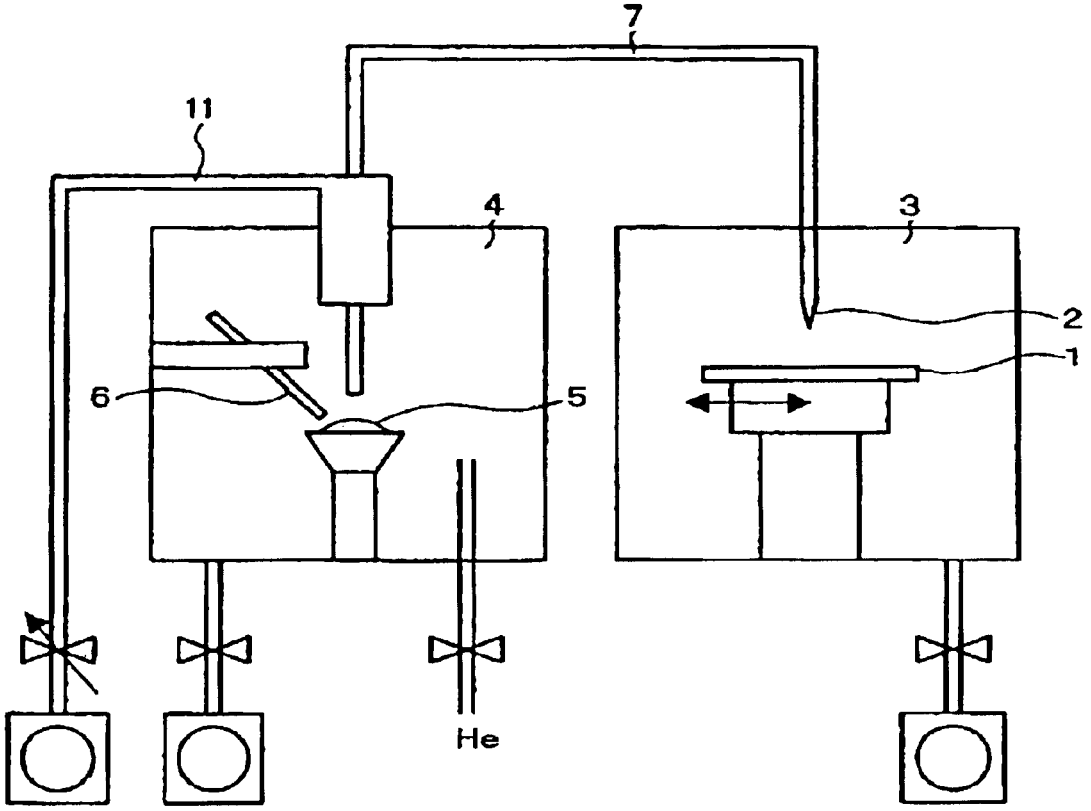
FIG. 1 is a schematic diagram of an apparatus for forming a fine-particle film using a gas deposition method.

The present invention is a method for manufacturing a water repellent member having a substrate and a water repellent film covering the surface of the substrate, comprising the steps of: transporting particles of a water repellent material with a gas; and discharging the transported particles from a nozzle to the substrate to form the water repellent film on the surface of the substrate.

The followings are preferable modes of the present invention.

The method for manufacturing a water repellent member may further comprise the step of generating the particles to be transported by heating a material having water repellent properties.

For the above heating, heating with arc discharge, high frequency induction heating, or resistance heating may be used.

Furthermore, the above method may further comprise the step of aerosolizing the particles to be transported.

Furthermore, the aerosolization may be performed by heating a material having water repellent properties to vaporize the material having water repellent properties, and contacting the vaporized material having water repellent properties with an inert gas.

The aerosolization may be performed by mixing the particles to be transported with the gas.

The particles to be discharged on the substrate may be comprised of plural kinds of particles.

The particles to be transported may be comprised of plural kinds of particles, and the plural kinds of particles may be generated in the same chamber.

The particles to be transported may be comprised of plural kinds of particles, and an additional step by which the plural kinds of particles may be aerosolized in the same chamber is comprised.

The particles to be transported may be comprised of plural kinds of particles, an additional step by which the plural kinds of particles may be aerosolized in different chambers is comprised, and the discharge to the substrate may be performed by discharging the plural kinds of particles from their respective nozzles different from each other.

The particles to be transported may be comprised of plural kinds of particles, an additional step by which the plural kinds of particles may be aerosolized in different chambers is comprised, and the discharge to the substrate may be performed by mixing the plural kinds of particles and discharging a mixture from the same nozzle.

The particles of the material having water repellent properties may have particle sizes of 0.5 $\mu$m or less.

The particles of the material having water repellent properties are made of a resin containing at least carbon atoms and fluorine atoms.

The particles of the material having water repellent properties are made of a resin containing at least silicon atoms.

The plural kinds of particles may include particles made of a resin containing at least carbon atoms and fluorine atoms and particles made of a metal or a metal oxide.

The plural kinds of particles may include particles made of a resin containing at least silicon atoms and particles made of a metal or a metal oxide.

The metal may be one of nickel, titanium, gold, silver, and copper.

Furthermore, the metal included in the metal oxide may be one of aluminum, titanium, and silicon.

Furthermore, the water repellent film on the surface of the substrate may be heated and melted during or after discharging the particles on the substrate.

Here, the gas deposition process to be used in the above preferred embodiments of the present invention will be described briefly.

There are two types of the gas deposition processes known in the art depending on the difference of the formation of aerosol between them. That is, one is a vaporization process that forms aerosol after the generation of particles by vaporizing the material and the other is an aerosol process that forms aerosol from particles when the material is provided as particles.

Referring now to FIG. 1, there is shown a schematic illustration of a film-forming apparatus in which a vaporization process is applied as an aerosol-forming process.

In the vaporization process, as shown in the figure, the material is vaporized in a particle-generating chamber (a vacuum chamber) 4, vaporized atoms of the material are brought into collision with an inert gas introduced in the particle-generating chamber 4 and is then rapidly cooled to combine vaporized atoms, generating particulate matter. The vaporized material is generated by an evaporating source in the particle-generating chamber 4. That is, it is generated by heating the material with a heating mechanism such as an arc heating electrode 6 or the like. Here, the heating mechanism (the heating system) to be applied may be arc melting, high frequency induction heating, resistance heating, electron beam, electric heating, plasma jet, laser beam heating, and so on. In the figure, furthermore, the reference numeral 11 denotes an excess particle exhausting mechanism for exhausting excess particles from the particle-generating chamber 4.

The average size of particles generated as described above varies depending on the amount and species of gas being introduced in the particle-generating chamber 4. In general, the average size of particles is in the range of several nanometers to several micrometers, preferably 0.5 $\mu$m or less.

Furthermore, the particles generated from the particle-generating chamber 4 are introduced into a particle film-forming chamber 3 together with gas through a particle-transporting pipe 7. In the film-forming chamber 3, from a nozzle 2 attached on the tip of the particle-transporting pipe 7, the particles are discharged together with the gas onto the surface of a substrate 1 which is a target of the film formation. At the time of film formation, the adhesiveness of the resulting film increases when the substrate 1 has heated in advance. Alternatively, the adhesiveness of the film can be increased by heating and dissolving the film during or after the film formation.

In the aerosol process, a container that contains particles is shaken to make aerosol. Then the resulting aerosol is transferred and introduced into a film-forming chamber using a carrier gas such as a helium gas or a nitrogen gas, followed by discharging the aerosol from a nozzle connected to the end of the transporting pipe at a high speed to draw and complete a repellent film.

If the water repellent film is formed by one of the above conventional methods, fine particles made of a water repellent material or the like may be of an average particle size of 0.5 $\mu$m or less. Therefore, the fine particles can be baked and combined to allow the fine particles to cover the surface of the water repellent member film.

As described above, the gas deposition process is capable of easily forming a coatings film having water repellent properties and the resistance to scuffing in excess of a certain level since the process allows the film formation directly from a water repellent material such as metal, oxide, or fluororesin by the steps of making the material into particles or aerosol, transporting, discharging, and film formation.

Hereinafter, we will describe preferred embodiments of the present invention and examples thereof in an illustrative manner with reference to the attached drawings. However, the dimensions, materials, relative configurations, and so on of structural components described in the embodiments do not intend to restrict the present invention within these limitations unless otherwise noted. Furthermore, the basic configuration of an entire ultra-fine particle film-forming apparatus with respect to the embodiments of the present invention is the same one as shown in FIG. 1, so that the explanations thereof will be omitted and characteristic features and so on of the embodiments or examples of the present invention will be only described in detail.

The water repellent material in accordance with the embodiment of the present invention is characterized in that the surface of the water repellent material is formed with fine particles having an average particle size of 0.5 $\mu$m or less.

In the method for manufacturing the water repellent material in accordance with the embodiment of the present invention, the gas deposition process forms a thin film by making fine particles into aerosol and blowing the aerosol together with a transporting gas onto the surface of a substrate, where a material to be made into aerosol is fine particles of a resin containing at least carbon atoms (C) and fluorine atoms (F), or silicon atoms (Si), or a material to be made into particles is fine particles of a resin containing at least C and F or Si, and fine particles consisting of metal oxide.

Hereinafter, we will describe the water repellent member in detail.

When an average particle size of fine particles formed in a fine particle generating chamber or an aerosol forming chamber is 0.5 $\mu$m or less at the time of forming a water repellent member using a gas deposition process, the adhesive properties of the particles discharged from a nozzle to the surface of a substrate becomes more favorable at the time of forming a water repellent film on the substrate in a film-forming chamber.

In the present embodiment, the average particle size of fine particles is defined in the range of 0.5 $\mu$m or less, so that the average particle size of fine particles that forms the surface of the water repellent member will be in the range of 0.5 $\mu$m or less.

Next, we will describe the method for manufacturing the water repellent member in detail.

When a material to be made into aerosol is a single material containing C and F or Si, the material can be made into aerosol by one of two ways. That is, at the time of making the material into fine particles and making the fine particles into aerosol, such a material is made into fine particles in a fine particle generating chamber previously charged with an inert gas and is then made into aerosol. Alternatively, at the time of making the material previously provided as fine particles into aerosol, the fine particles contained in a container is shaken in an aerosol forming chamber to make the fine particles into aerosol.

Here, as a method for making the material containing C and F or Si into fine particles in the fine particle generating chamber, one of resistance heating, high frequency induction heating, laser heating, and so on in an inert gas atmosphere may be used.

In addition, at the time of making the fine particles into aerosol in the aerosol forming chamber, the container containing the fine particles may be shaken or may be subjected to sonication or the like.

The aerosol containing C and F or Si being aerosolized in the fine particle generating chamber or the aerosol generating chamber is transferred together with gas to the film-forming chamber through the transporting pipe. Subsequently, the transferred aerosol is discharged from the nozzle while being drawn over the substrate to cover the surface of the substrate with the water repellent film to complete the water repellent member.

Next, we will describe the case in which two or more different materials are used for the formation of a water repellent film on the substrate of a water repellent member.

At the time of aerosolizing the material (hereinafter referred to as a first material) containing C and F or Si for the formation of a water repellent film, the first material is made into fine particles in a fine particle generating chamber being filled with an inert gas if there is a need to be pulverized into fine particles in advance. If the first material is previously provided as fine particles, on the other hand, the fine particles are filled in an aerosol generating chamber and are then aerosolized.

In the case of aerosolizing a material containing C and F or Si for the formation of a water repellent material, or a metal oxide (hereinafter referred to as a second material), the second material is made into fine particles in a fine particle generating chamber being filled with an inert gas if there is a need to be pulverized into fine particles in advance. If the second material is previously provided as fine particles, on the other hand, the fine particles are filled in an aerosol generating chamber and are then aerosolized.

In the middle of separately transferring the aerosol containing the first material and the aerosol containing the second material using gas, these two streams of the aerosol are combined together to form mixed aerosol of the first and second material. Then, the mixed aerosol was introduced into a film-forming chamber through a transporting pipe and is then discharged from a nozzle at a high speed while being drawn over a substrate to form a water repellent film on the surface of the substrate.

In this process, therefore, the fist material and the second material are separately aerosolized in their respective fine particle generating chambers or respective aerosol generating chambers, and the different streams of aerosol are then combined together in the middle of the transporting pipes to form a mixed laminar flow.

Consequently, it becomes possible to prepare a water repellent film having a desired mixing ratio of the first and second materials by only adjusting the flow rate of each stream of the aerosol at the time of combining the stream of the first material's aerosol and the stream of the second material's aerosol.

Furthermore, a water repellent film having any given distribution of mixing ratio in the direction of film thickness can be also prepared by only adjusting the above flow rate.

Such a kind of the film formation also allows an increase in the adhesion of the water repellent film to the substrate.

Likewise, a water repellent film composed of three or more different materials may be also formed by separately aerosolizing these materials in their respective fine particle generating chambers or respective aerosol generating chambers to form aerosol, followed by combining different streams of aerosol in the middle of their transporting porting pipes.

The above processes are ones wherein different streams of aerosol are combined in the middle of transporting pipes to form a mixed gas.

Alternatively, in the case of using two or more materials to form a water repellent film, different materials are independently made into fine particles using heating means or the like in the same fine particle generating chamber. Then, a mixed gas in which the fine particles of these different materials are dispersed is formed and is then aerosolized. When the material is previously made into fine particles, on the other hand, the fine particles are mixed in the aerosol forming chamber and are then aerosolized. The resulting aerosol is introduced together with a gas into a film-forming chamber through a transporting pipe, followed by discharging from a nozzle at a high speed while being drawn over a substrate to form a water repellent film on the surface of the substrate.

Alternatively, in the case of using two or more materials to form a water repellent film, a material (a first material) containing C and F or Si for the formation of the water repellent film is made into fine particles in a fine particle generating chamber being filled with an inert gas if there is a need to be pulverized into fine particles in advance. When the first material is provided as fine particles in advance, on the other hand, the fine particles is filled in an aerosol generating chamber and is then aerosolized.

In the case of aerosolizing a material containing C and F or Si for the formation of a water repellent material, or a metal oxide (a second material), the second material is made into fine particles in a fine particle generating chamber being filled with an inert gas if there is a need to be pulverized into fine particles in advance. When the second material is provided as fine particles in advance, on the other hand, the fine particles is filled in an aerosol generating chamber and is then aerosolized.

In this process, as described above, two kinds of aerosol obtained by making the materials into aerosol in the fine particle generating chamber or the aerosol generating chamber are separately transferred together with gas through their respective transporting pipes to a film-forming chamber. Immediately before discharging the aerosolized materials from different nozzles in the film-forming chamber, these materials are mixed together to form a water repellent film.

Furthermore, as a more concrete example using the above method for manufacturing a water repellent member, we will describe a method for manufacturing an inkjet head.

At first, an inkjet recording apparatus has been known as one which is excellent in low noise, high speed printing, and so on. In the inkjet recoding apparatus, a liquid such as ink is supplied to an inkjet head that employs electromechanical transducers (e.g., piezo elements) as discharge-energy generating elements. These elements are driven on the basis of drive signals corresponding to recoding information and image information to discharge liquid droplets from the corresponding nozzles to perform printing of recording information, image information, and so on.

Figure 8:
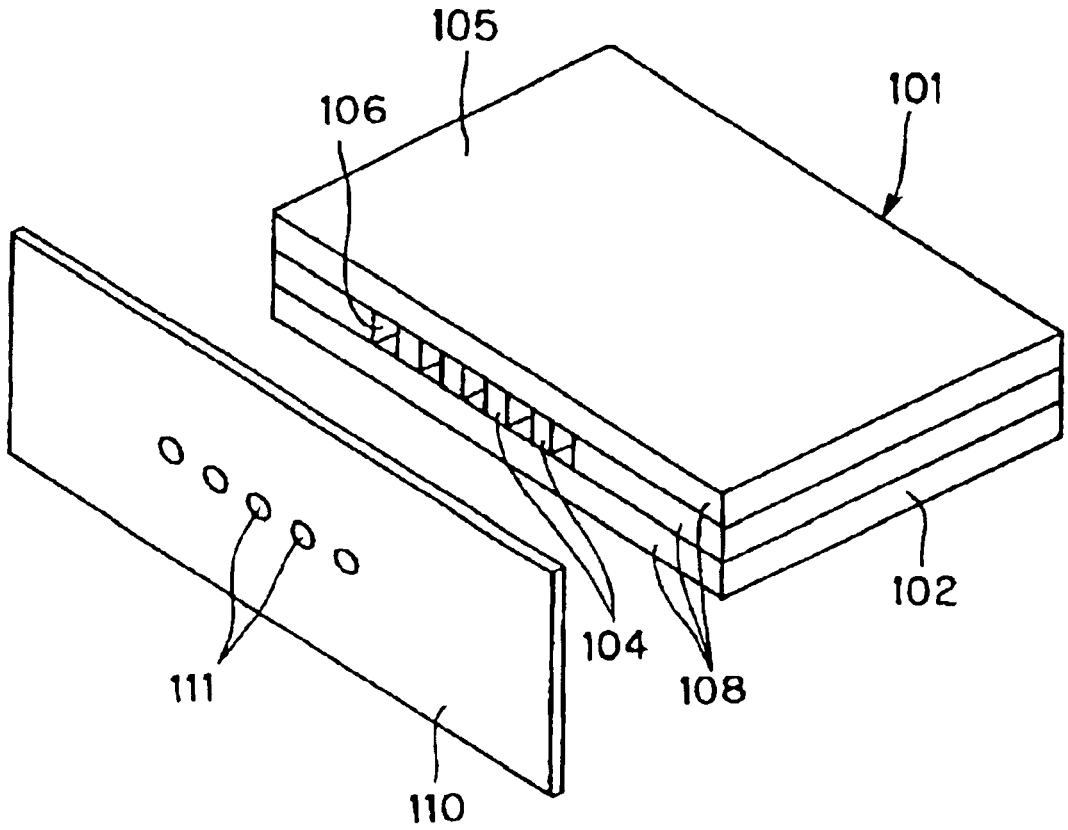
FIG. 8 is a schematic diagram for illustrating the configuration of an inkjet head.

Here, as shown in FIG. 8, the above inkjet head comprises a head substrate 101 and an orifice plate 110. The head substrate 101 includes an element substrate 102 on which liquid (e.g., ink)-discharging means (i.e., discharge-energy generating elements, not shown) are formed, liquid flow path walls 104 for partitioning liquid flow paths 106 on the element substrate 102, and atop plate 105 provided as the upper side of each liquid flow path 106, in which a liquid chamber (not shown) for supplying the liquid to the liquid flow paths 106 is formed. Therefore, the head substrate 101 is constructed by bonding the element substrate 102 and the top plate 105 through the liquid flow path walls 104. The orifice plate 110 has a plurality of ink discharge orifices 111 corresponding to the liquid flow paths 106 and is fixed on the surface 108 of the head substrate 101 through an adhesive, where the openings of the liquid flow paths of the head substrate 101 are formed in the surface 108 of the head substrate 101. Furthermore, the surface of the orifice plate 110 has an ink repellent property, so that ink droplets can be prevented from being stayed around the ink discharge orifices 111 at the time of ink-discharge, improving the stability of discharge.

The method for manufacturing the inkjet taking advantage of the above method for manufacturing the water repellent member is characterized in that the above orifice plate is fabricated by the same method as that of manufacturing the water repellent member described above.

However, the water repellent film in the method for manufacturing the water repellent member described above should be an ink repellent film in the method for manufacturing the inkjet head. Therefore, particles used in the latter method are those having ink repellent properties. In the case of particles made of a material having the ink repellent property, an average particle size thereof is more preferably 1 μm or less. In the case of particles of the above metal or metal oxide, an average particle size thereof is more preferably 0.1 μm or less.

Excepting these facts, all of the above described embodiments of the method for manufacturing the water repellent member can be applied on the method for manufacturing the inkjet head.

Hereinafter, we will describe the present invention with reference to the examples there of. However, the present invention is not limited to the following examples.

FIRST EXAMPLE

Figure 2:
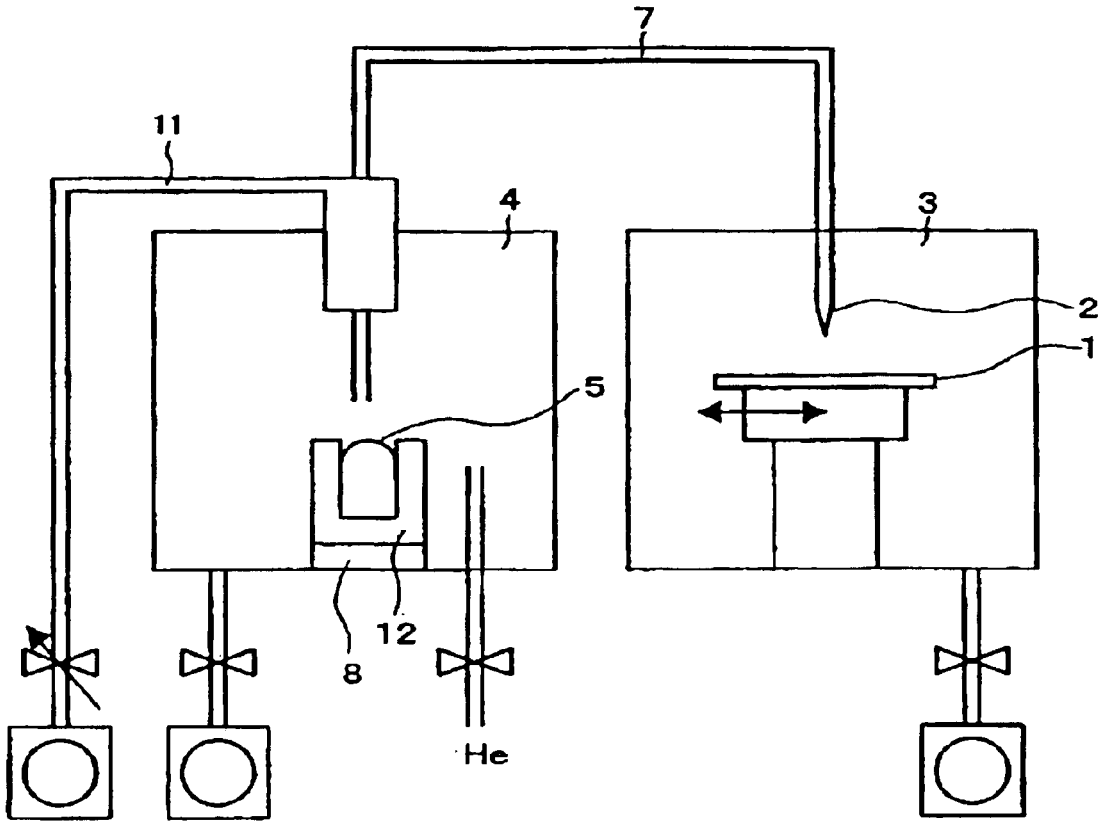
FIG. 2 is a schematic diagram of an apparatus for forming a fine-particle film used in a first example of the present invention.

Referring now to FIG. 2, we will be described a method for forming a fine particle film and a fine particle film forming apparatus in accordance with the first embodiment. In FIG. 2, there is schematically illustrated the fine particle film forming apparatus in accordance with the first example.

In this example, we will described a case in which a material to be used in the formation of a water repellent film is a single material which is not pulverized.

At first, a tetrafluoroethylene resin was provided as a raw material 5 of a water repellent film and was then placed in a crucible 12 in a fine particle-generating chamber 4. Then, the crucible 12 was heated with an induction heating electric source 8 at a high frequency of 20 kW to dissolve the tetrafluoroethylene resin to fill the crucible 12 with melted resin.

Furthermore, the crucible 12 was further heated to vaporize the tetrafluoroethylene resin, resulting in ultra-fine particles of tetrafluoroethylene. The resulting particles had particle sizes ranging from 3 nm to 500 nm.

The vapor of vaporized tetrafluoroethylene resin was aerosolized together with a carrier gas (i.e., a helium (He) gas). Then, the aerosol was transferred to a fine particle film-forming chamber 3 by means of a pressure difference between the chambers 3 and 4. Consequently, an ultra-fine particle film made of the tetrafluoroethylene resin was prepared.

As a particle-transporting pipe 7 was fixed in place, a substrate 1 was moved as a scanning movement in a predetermined direction (as indicated by the double-headed arrow in the figure) to form a linear water repellent film on the surface of the substrate 1. In this case, the moving speed of the substrate 1 is 0.1 mm/s.

The film thickness of the film thus obtained was measured using a contact-type thickness meter. As a result, the thickness of the film was about 50 μm.

In this example, the following film-forming conditions were used. That is, the diameter of the nozzle was ϕ1 mm; the substrate used was a glass substrate; the substrate was not heated; the pressure of the chamber for generating ultra-fine particles was 500 torr (66500 Pa); the flow rate of He gas was 10 L/min; and the pressure of the film-forming chamber was 0.1 torr (13.3 Pa). Furthermore, the adhesion of the ultra-fine particle film on the substrate 1 increased as the film on the substrate was heated at a temperature of 300° C. for 10 minutes.

SECOND EXAMPLE

Figure 3:
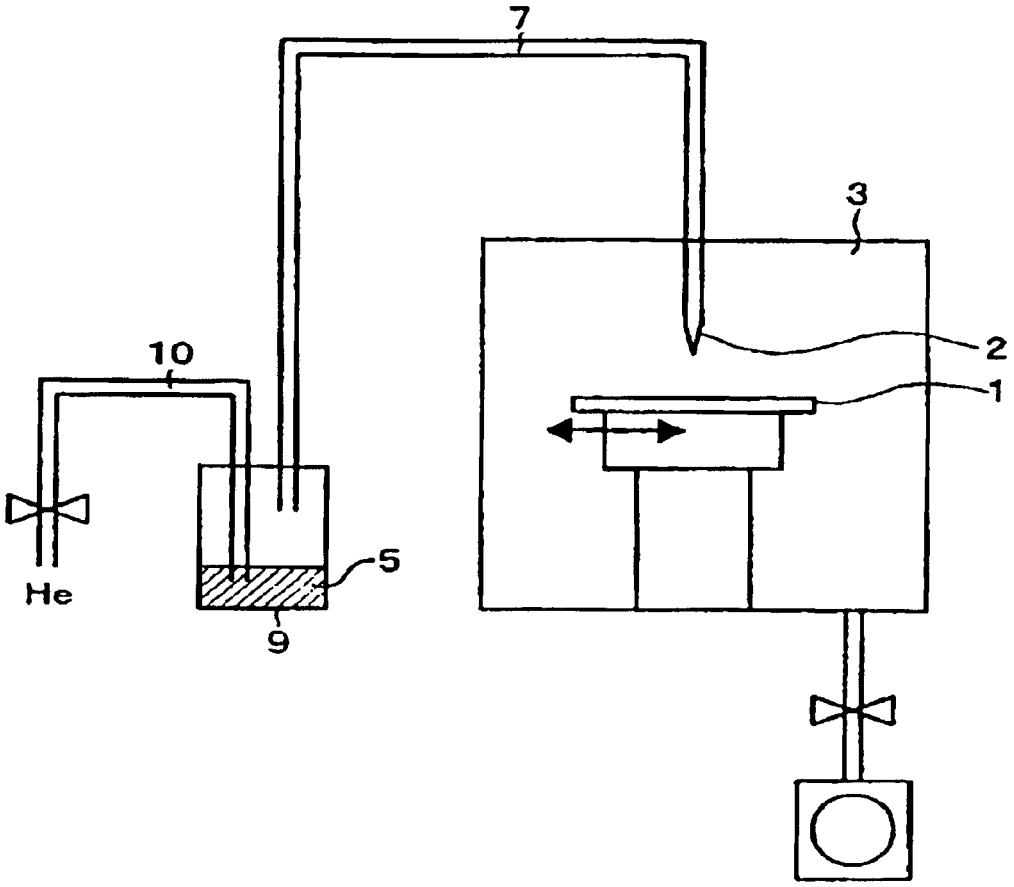
FIG. 3 is a schematic diagram of an apparatus for forming a fine-particle film used in a second example of the present invention.

Referring now to FIG. 3, we will describe a method for preparing a fine particle film and an apparatus used in such a method in accordance with a second example of the present invention. FIG. 3 is a schematic diagram of the apparatus for preparing a fine particle film in accordance with the second example of the present invention.

In this example, we will described a case in which a material to be used in the formation of a water repellent film is a single material being pulverized.

At first, a vessel in an aerosol-forming chamber 9 was filled with fine particles of tetrafluoroethylene having a particle size of 0.2 μm as a raw material 5. Then, He gas was introduced into the vessel through a gas-transporting pipe 10 to aerosolize the fine particles.

The aerosolized fine particles were ridden on a carrier gas of He and were then transferred to a fine particle film-forming chamber 3 by means of a pressure difference between the chambers 3 and 9 through a particle-transporting pipe 7. Subsequently, the fine particles were discharged at a high speed from a nozzle 2 attached on the tip of the pipe 7. Consequently, an ultra-fine particle film made of the tetrafluoroethylene resin was prepared on the surface of a substrate 1.

Figure 4:
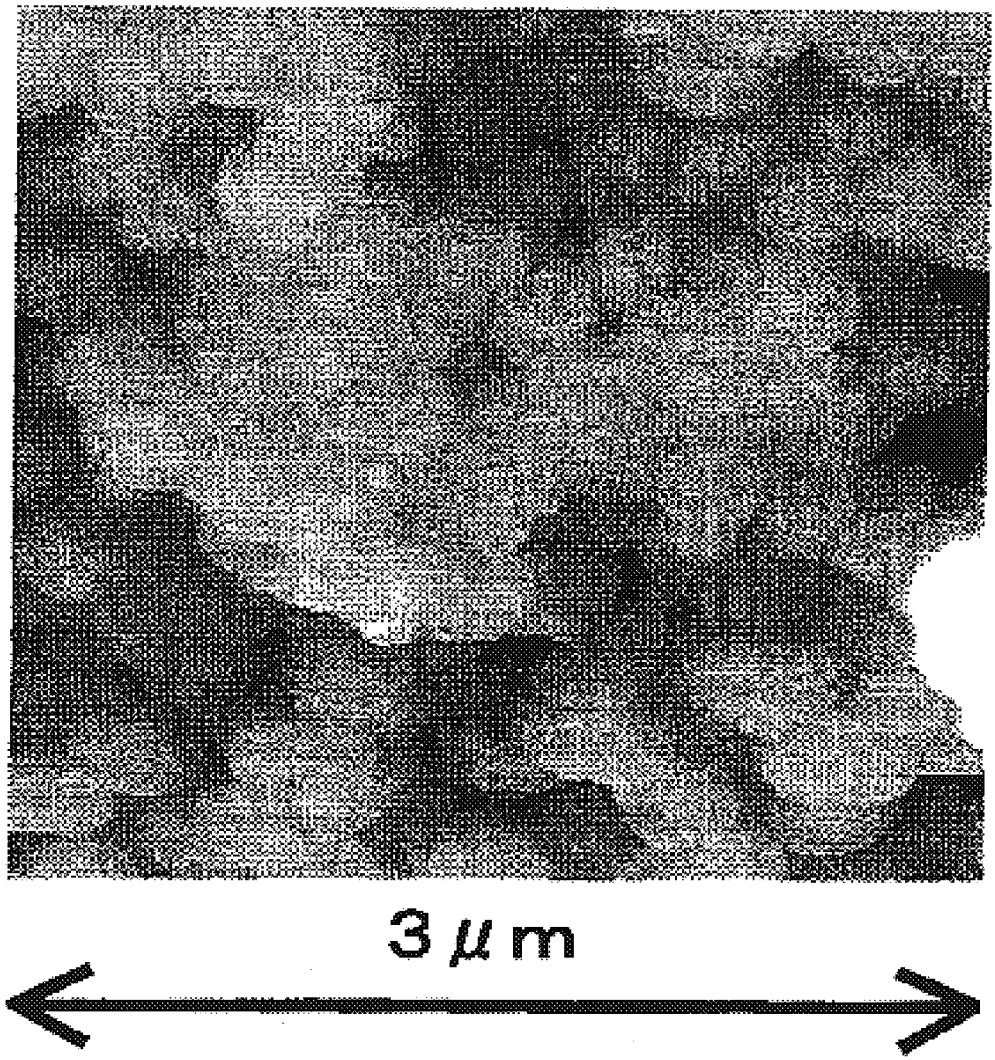
FIG. 4 is a photographic representation of the result obtained by AFM observation of the sur face of a water repellent film used in a second example of the present invention.

The resulting film was subjected to a microscopic observation using an atomic force microscope (AFM) and the result was shown in FIG. 4.

As shown in FIG. 4, it is found that particles of about 0.2 μm are bonded together on the surface of the film. Others are same as those of the first example.

THIRD EXAMPLE

Figure 5:
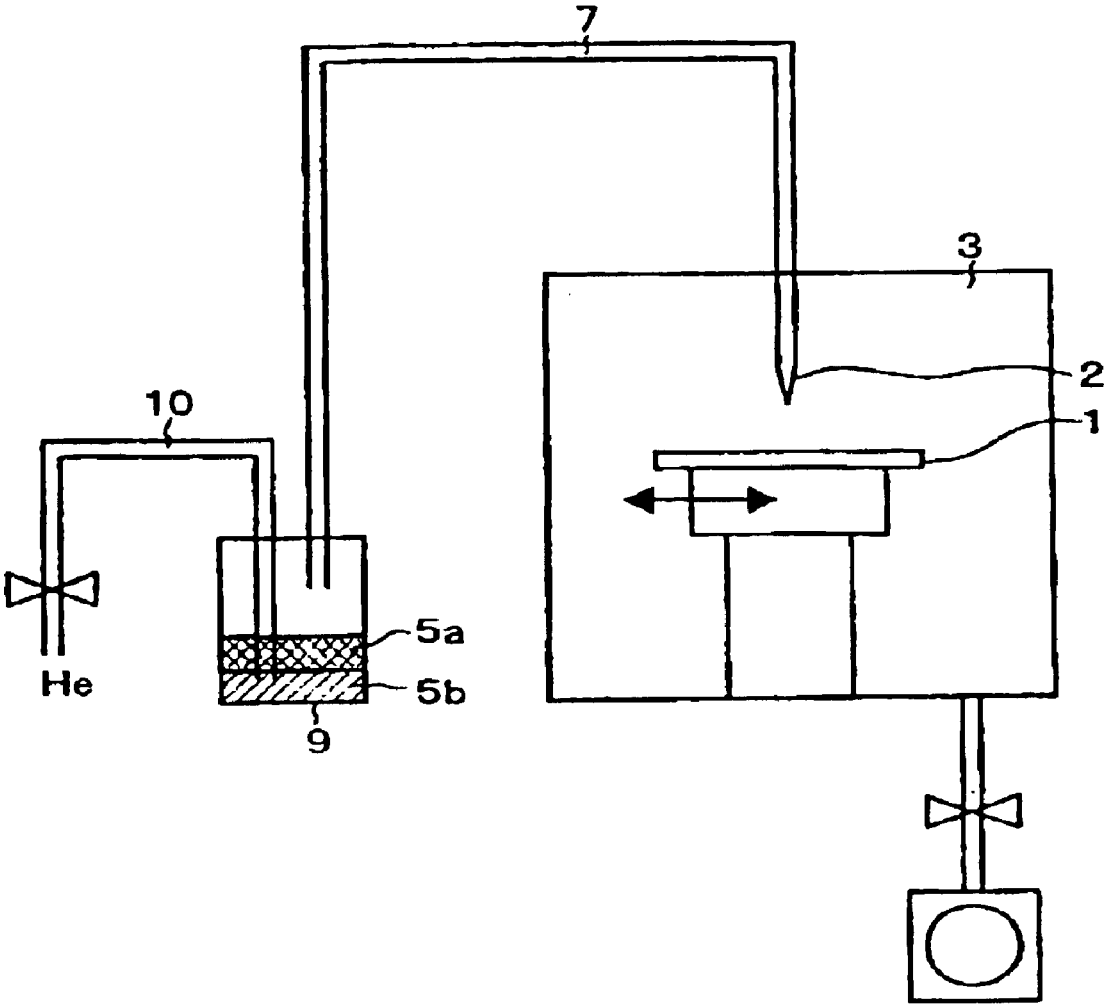
FIG. 5 is a schematic diagram of an apparatus for forming a fine-particle film used in a third example of the present invention.

Referring now to FIG. 5, we will describe a method for preparing a fine particle film and an apparatus used in such a method in accordance with a third example of the present invention. FIG. 5 is a schematic diagram of the apparatus for preparing a fine particle film in accordance with the third example of the present invention.

In this example, we will describe a case in which two materials are used in the formation of a water repellent film and both of them are being pulverized. In this case, furthermore, fine particles of the respective materials are aerosolized in the same aerosol-forming chamber.

At first, a vessel equipped in the aerosol-forming chamber 9 was filled with fine particles (a material-5*a*) made of tetrafluoroethylene and fine particles (a material-5*b*) made of $Al_2O_3$, followed by introducing He gas into the vessel through a gas-transporting pipe 10. As a result, the fine particles of both materials-5*a*, 5*b* were aerosolized and mixed together.

The aerosolized fine particles were ridden on a carrier gas (i.e., a helium (He) gas). Then, the aerosol was transferred to a fine particle film-forming chamber 3 by means of a pressure difference between the chambers 3 and 9 through a fine particle-transporting pipe 7. Subsequently, the aerosol was discharged at a high speed from a nozzle 2 attached on the tip of the pipe 7. Consequently, an ultra-fine particle film made of the tetrafluoroethylene and $Al_2O_3$ was prepared on the surface of a substrate 1. Others are same as those of the first example.

FOURTH EXAMPLE

Figure 6:
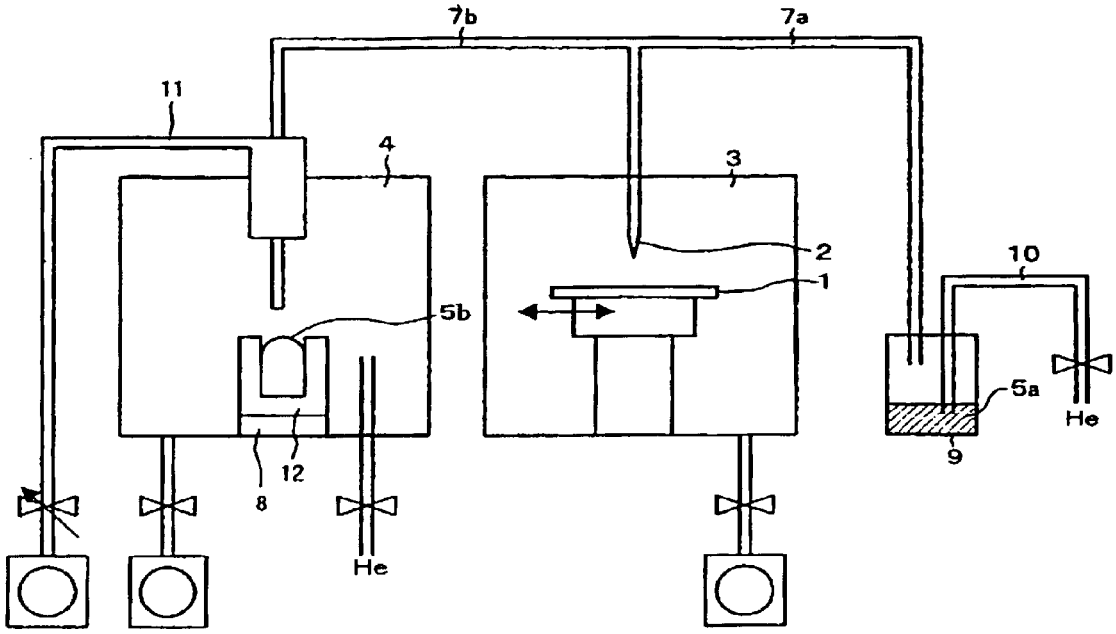
FIG. 6 is a schematic diagram of an apparatus for forming a fine-particle film used in a fourth example of the present invention.

Referring now to FIG. 6, we will describe a method for preparing a fine particle film and an apparatus used in such a method in accordance with a fourth example of the present invention. FIG. 6 is a schematic diagram of the apparatus for preparing a fine particle film in accordance with the fourth example of the present invention.

In this example, we will describe a case in which two materials are used in the formation of a water repellent film and one of them is being pulverized. In this case, these materials are aerosolized in different chambers and are discharged from different nozzles to the same area on a substrate.

At first, a vessel in an aerosol-forming chamber 9 was filled with fine particles (a material-5*a*), followed by introducing He gas into the vessel through a gas-transporting pipe 10 to aerosolize the fine particles of tetrafluoroethylene.

On the other hand, a crucible 12 in a particle-generating chamber 4 was filled with Ni (a material-5*b*) and was then heated by an induction heating electric source 8 at a high frequency of 25 kW. As a result, molten Ni filled the crucible 12.

Furthermore, successive heating allowed the Ni to be vaporized. The Ni vapor was ridden on a carrier gas of He and was then aerosolized.

These two kinds of aerosol (tetrafluoroethylene and Ni) were separately introduced into a fine particle film-forming chamber 3 by means of gas-transportation through a fine-particle transporting pipe 7, followed by discharging these kinds of aerosol from different nozzles 2 at a high speed to form an ultra-fine particle film made of tetrafluoroethylene and Ni on the surface of a substrate. Others are same as those of the first example.

FIFTH EXAMPLE

Figure 7:
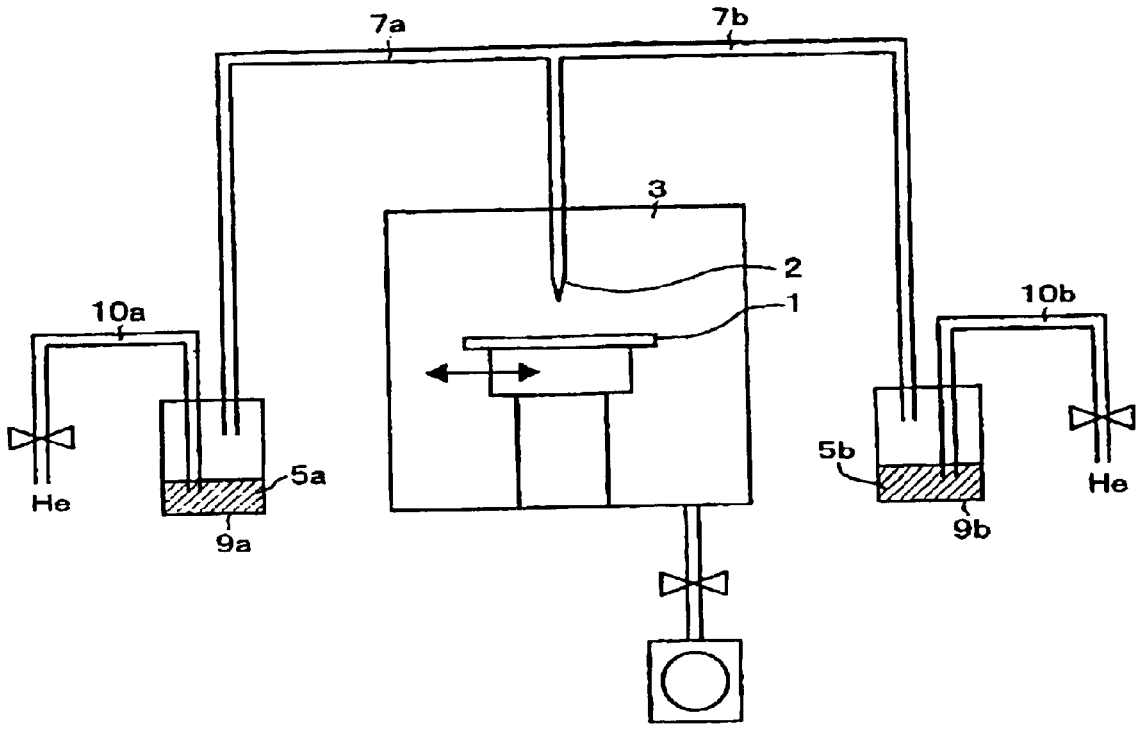
FIG. 7 is a schematic diagram of an apparatus for forming a fine-particle film used in a fifth example of the present invention.

Referring now to FIG. 7, we will describe a method for preparing a fine particle film and an apparatus used in such a method in accordance with a fifth example of the present invention. FIG. 7 is a schematic diagram of the apparatus for preparing a fine particle film in accordance with the fifth example of the present invention.

In this example, we will describe a case in which two materials are used in the formation of a water repellent film and both of them are being pulverized. In this case, these materials are aerosolized in different chambers and are combined together in the middle of their transporting pipes to discharge them from the same nozzle to a substrate.

At first, a vessel in an aerosol-forming chamber 9*a* was filled with fine particles made of Sires in (a material-5*a*), followed by introducing He gas into the vessel through a gas-transporting pipe 10*a* to aerosolize the fine particles of Si resin.

Also, a vessel in another aerosol-forming chamber 9*b* was filled with fine particles made of $Al_2O_3$ (a material-5*b*), followed by introducing He gas into the vessel through a gas-transporting pipe 10*b* to aerosolize the fine particles of $Al_2O_3$.

The two kinds of aerosol were separately transferred together with gas through different transporting pipes 7*a*, 7*b* and were combined in the middle of the transporting pipes 7*a*, 7*b* to form a mixed flow of aerosol.

Subsequently, the mixed flow was introduced into a fine particle film-forming chamber 3 and was then discharged from a nozzle 2 at a high speed to form an ultra-fine particle film made of Si resin and $Al_2O_3$on the surface of a substrate 1. Others are same as those of the first example.

SIXTH EXAMPLE

Nozzle holes (30 $\mu$m in diameter) were formed with 100 $\mu$m pitches in a nickel plate (75 $\mu$m in thickness). The resulting plate was provided as a base material of an orifice plate.

Alternatively, as a base material of the orifice plate, a glass or a resin may be used in stead of a metal material.

The nickel plate was dipped in acetone and was then subjected to an ultrasonic washing for 5 minutes.

Figure 9:
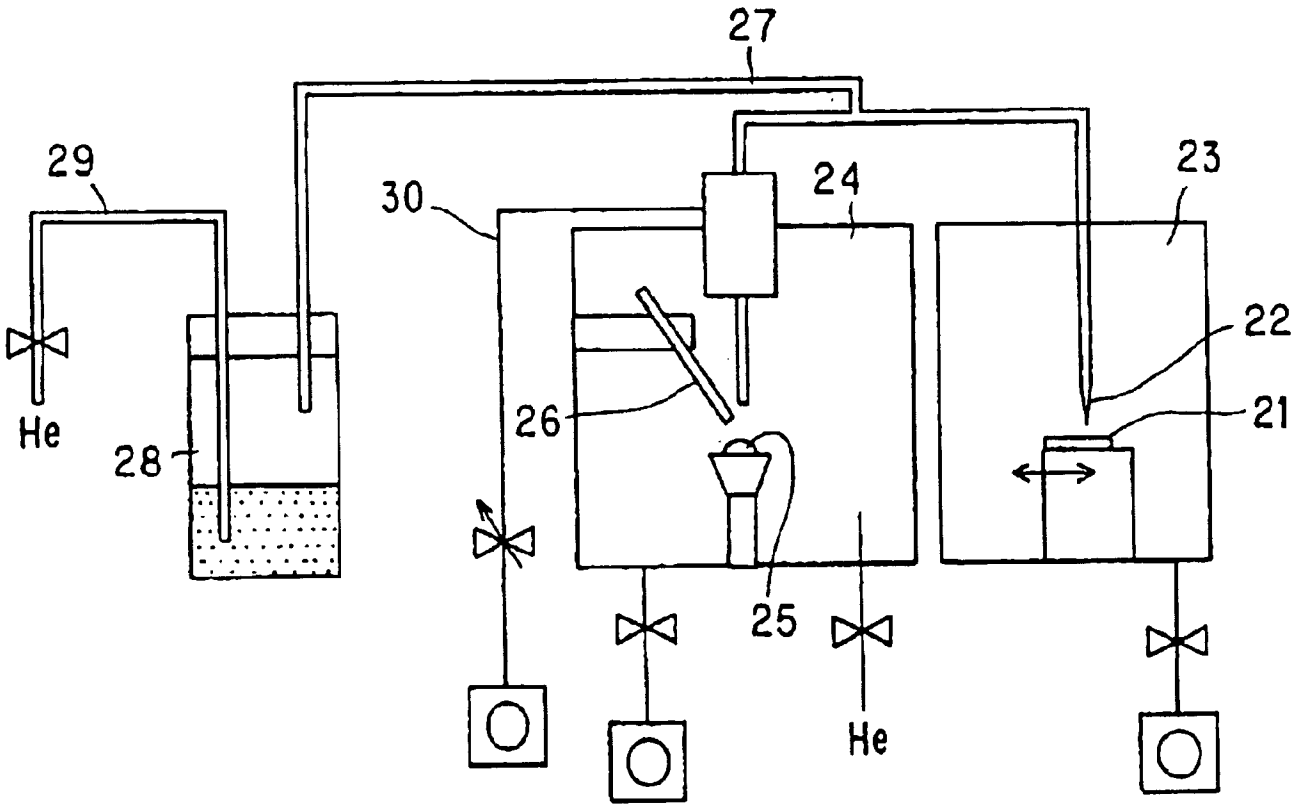
FIG. 9 is a schematic diagram of an apparatus for forming a fine-particle film used in one of sixth to eighth examples of the present invention.

After washing and drying, the nickel plate was provided as a substrate 21 and was then placed on a drawing stage of a film-forming chamber 23 in a gas deposition apparatus shown in FIG. 9.

As an ink-repellent material provided as fine particles, polytetrafluoroethylene (PTFE) (trade name: "Leblond L5-F (low molecular weight polytetrafluoroethylene)", commercially available from Daikin Industries, Ltd.) was used. A microscopic observation using a scanning electron microscopy (SEM) revealed that the average particle size of the fine particles was about 0.2 $\mu$m. The fine particles were placed in a vessel (in an aerosol-forming chamber 28) and were then aerosolized by shaking.

Under the conditions listed in Table 1, ultra-fine particles were transferred to a film-forming chamber 23 through a transporting pipe 27. Then, the ultra-fine particles were discharged from a nozzle 22 (1 mm in diameter) attached on the tip of the transporting pipe 27 to the surface of a nickel plate 21 to form a film thereon.

TABLE 1

| | |
|---|---|
| The species of the carrier gas | Helium |
| The flow rate of the gas (SLM) | 30 |
| The pressure of the film-forming chamber (Torr) | 1 |
| The temperature of the substrate | Room Temp. |

After the film formation, the substrate was subjected to a thermal treatment in an atmospheric furnace at 350° C. for 1 hour.

Subsequently, the contact angle of the outer surface of the orifice plate thus obtained to water was measured and a contact angle of 119° was obtained. For evaluating the durability of the orifice plate, a rubbing test was performed. In the rubbing test, printer ink or water was dropped on the orifice plate and the surface of the orifice plate was rubbed 3000 times using a wiper blade (trade name: "Bemcot", commercially available from Asahi Kasei Corporation ). After the test, the contact angle was measured, resulting in 110°. In the figure, furthermore, the reference numeral 29 denotes a gas-transporting pipe to introduce He gas into the vessel (the aerosol-forming chamber 28).

SEVENTH EXAMPLE

An orifice plate substrate made of nickel was used just as in the case with the sixth example.

The nickel plate was dipped in acetone and was then subjected to an ultrasonic washing for 5 minutes.

After washing and drying, the nickel plate (i.e., a substrate 21) was placed on a drawing stage of a film-forming chamber 23 in a gas deposition apparatus shown in FIG. 9. In this example, two chambers were provided for the generation of ultra-fine particles, one for metal fine particles and the other for ink-repellent material. In the chamber 24 for the generation of metal fine particles, a nickel material was heated by arc discharge from an arc-heating means 26 to generate ultra-fine particles of nickel. A microscopic observation using a scanning electron microscopy (SEM) revealed that the average particle size of the nickel ultra-fine particles was about 50 nm. The fine particles were aerosolized using helium gas. For the manufacture of nickel ultra-fine particles, a high frequency induction heating, resistance heating, or the like may be used in stead of the arc heating. The metal fine particles maybe titanium, gold, silver, or copper may be used in stead of nickel.

As the ink-repellent material, polytetrafluoroethylene (PTFE) (trade name: "Leblond L5-F (low molecular weight polytetrafluoroethylene)", commercially available from Daikin Industries, Ltd.) wasused. The PTFE was placed in a vessel.(an aerosol-forming chamber 28) and was then aerosolized by shaking.

Under the conditions listed in Table 2, ultra-fine particles were transferred to a film-forming chamber 23 through a transporting pipe 27. Then, a mixture of the nickel ultra-fine particles and PTFE fine particles was discharged from a nozzle 22 (1 mm in diameter) attached on the tip of the transporting pipe 27 to the surface of a nickel plate 21 to form a film thereon.

TABLE 2

| | |
|---|---|
| The species of the carrier gas | Helium |
| The flow rate of the gas (SLM) | 30 |
| The pressure of the film-forming chamber (Torr) | 1 |
| The pressure of the arc-generating chamber | 500 |

After the film formation, the substrate was subjected to a thermal treatment in an atmospheric furnace at 330° C. for 1 hour.

Subsequently, the contact angle of the outer surface of the orifice plate thus obtained to water was measured and a contact angle of 115° was obtained. For evaluating the durability of the orifice plate, the same rubbing test as that of the sixth example was performed. After the test, the contact angle was measured, resulting in 108°. In the figure, furthermore, the reference numeral 30 denotes an excess particle exhausting mechanism for exhausting excess particles from the chamber 24.

EIGHTH EXAMPLE

An orifice plate substrate made of nickel was used just as in the case with the sixth example.

The nickel plate was dipped in acetone and was then subjected to an ultrasonic washing for 5 minutes.

After washing and drying, the nickel plate (i.e., a substrate 21) was placed on a drawing stage of a film-forming chamber 23 in a gas deposition apparatus shown in FIG. 9. In this example, two chambers were provided for the generation of ultra-fine particles, one for metal fine particles and the other for ink-repellent material.

As the metal oxide fine particles, alumina was used. The alumina was placed in a vessel (in an aerosol-forming chamber 28) and was then aerosolized by shaking. Alternatively, the metal oxide fine particles may be titanium oxide or silicon oxide in stead of alumina.

As the ink-repellent material, polytetrafluoroethylene (PTFE) (trade name: "Leblond L5-F (low molecular weight polytetrafluoroethylene)", commercially available from Daikin Industries, Ltd.) was used. The PTFE was placed in a vessel equipped in an aerosol-forming chamber (not shown, but same as one denoted by reference numeral 28) and was then aerosolized by shaking.

These ultra-fine particles were transported using helium as a carrier gas. Then, a mixture of the alumina ultra-fine particles and PTFE fine particles was discharged from a nozzle 22 (1 mm in diameter) attached on the tip of the transporting pipe 27 to the surface of a nickel plate 21 to form a film thereon.

After the film formation, the substrate was subjected to a thermal treatment in an atmospheric furnace at 330° C. for 1 hour.

Subsequently, the contact angle of the outer surface of the orifice plate thus obtained to water was measured and a contact angle of 118° was obtained. For evaluating the durability of the orifice plate, the same rubbing test as that of the sixth example was performed. After the test, the contact angle was measured, resulting in 111°.

According to the present invention, as described above, in a water repellent member having water repellent properties, weather resistance, antifouling property, and so on to be used in various products such as industrial equipments and electronic equipments, a water repellent film is formed on a substrate using a gas-deposition method. Therefore, the resulting uniform water repellent film has an excellent water repellent properties and an excellent durability. In addition, the water repellent film can be only formed on the surface that requires such physical properties by a simple process without passing through the steps of masking and so on and without restricting on the material of the water repellent material.

According to the present invention, as described above, an orifice plate of an inkjet head attains a high ink-repellent property and a high durability by forming an ink-repellent layer by a gas deposition method. Consequently, the discharge of ink can be performed with high accuracy and high stability.

The orifice plate of the inkjet head prepared by the gas deposition method exerts sufficient capabilities with respect to the speedup of printing, the stabilization of discharge, and the increase in durability, which will be further increased in the future, providing a way for allowing it to be developed in high-speed printings of photos and images and industrial applications.

What is claimed is:

1. A method for manufacturing a water repellent member having a substrate and a water repellent film covering a surface of the substrate, comprising the steps of:

contacting particles of a material having water repellent properties with an inert gas in a particle-generating chamber to form an aerosol of the particles; and transporting the aerosol of the particles through a particle-transporting pipe into a particle film-forming chamber and discharging the aerosol of the particles from a nozzle to the substrate to form the water repellent film on the surface of the substrate, wherein the particle-transporting pipe leads from the particle-generating chamber to the particle film-forming chamber.

2. A method for manufacturing a water repellent member according to claim 1, further comprising the step of:

generating the particles of the material having water repellent properties by heating the material having water repellent properties.

3. A method for manufacturing a water repellent member according to claim 1, wherein the water repellent film on the surface of the substrate is heated and melted during or after discharging the aerosol of the particles to the substrate.

4. A method for manufacturing a water repellent member according to claim 1, wherein the aerosol of the particles is formed by heating the material having water repellent properties to vaporize the material having water repellent properties, and contacting particles of the vaporized material having water repellent properties with the inert gas.

5. A method for manufacturing a water repellent member according to claim 1, wherein the particles of the material having water repellent properties are made of a resin containing at least silicon atoms.

6. A method for manufacturing a water repellent member according to claim 1, wherein plural kinds of particles are discharged to the substrate.

7. A method for manufacturing a water repellent member according to claim 6, wherein the plural kinds of particles are generated in the same particle-generating chamber.

8. A method for manufacturing a water repellent member according to claim 6, wherein the plural kinds of particles are aerosolized in the same particle-generating chamber.

9. A method for manufacturing a water repellent member according to claim 6, wherein the discharge of the plural kinds of particles to the substrate is performed by discharging the plural kinds of particles from respective nozzles different from each other.

10. A method for manufacturing a water repellent member according to claim 6, wherein the discharge of the plural kinds of particles to the substrate is performed by mixing the plural kinds of particles and discharging a mixture from the same nozzle.

11. A method for manufacturing a water-repellent member according to claim 6, wherein the plural kinds of particles are aerosolized in different particle-generating chambers.

12. A method for manufacturing a water repellent member according to claim 6, wherein the plural kinds of particles include particles made of a resin containing at least silicon atoms and particles made of a metal or a metal oxide.

13. A method for manufacturing a water repellent member according to claim 6, wherein the plural kinds of particles include particles made of a resin containing at least carbon atoms and fluorine atoms and particles made of a metal or a metal oxide.

14. A method for manufacturing a water repellent member according to claim 1, wherein the particles of the material having water repellent properties have particle sizes of 0.5 $\mu$m or less.

15. A method for manufacturing a water repellent member according to claim 1, wherein the particles of the material having water repellent properties are made of a resin containing at least carbon atoms and fluorine atoms.

16. A method for manufacturing an inkjet head equipped with an orifice plate having an ink-repellent surface, wherein the formation of the orifice plate includes the steps of:

contacting particles of a material having water repellant properties with an inert gas in a particle-generating chamber to form an aerosol of the particles; and transporting the aerosol of the particles through a particle-transporting pipe into a particle film-forming chamber and discharging the aerosol of the particles from a nozzle to the substrate to form an ink-repellent film on the surface of the substrate, wherein the particle-transporting pipe leads from the particle-generating chamber to the particle film-forming chamber.

* * * * *

UNITED STATES PATENT AND TRADEMARK OFFICE

CERTIFICATE OF CORRECTION

PATENT NO. : 6,783,800 B2
DATED : August 31, 2004
INVENTOR(S) : Yasuyuki Saito et al.

It is certified that error appears in the above-identified patent and that said Letters Patent is hereby corrected as shown below:

Column 2,
Line 43, “coating film) is difficult,” should read -- coating film), --.
Line 45, “are hardly rose” should read -- are hardly raised --.

Column 3,
Line 23, “sur face” should read -- surface --.

Column 7,
Line 19, “fist” should read -- first --.

Column 8,
Lines 1 and 2, “is” should read -- are --.
Line 29, “recoding” should read -- recording --.
Line 53, “being stayed” should read -- staying --.

Column 9,
Line 9, “there of.” should read -- thereof. --
Line 13, “we” should read -- there --.

Column 11,
Line 37, “Sires in” should read -- Si resin --.
Line 63, “in stead” should read -- instead --.

Column 12,
Line 65, “in stead” should read -- instead --.

Column 13,
Line 2, “wasused” should read -- was used. --.

UNITED STATES PATENT AND TRADEMARK OFFICE

CERTIFICATE OF CORRECTION

PATENT NO. : 6,783,800 B2
DATED : August 31, 2004
INVENTOR(S) : Yasuyuki Saito et al.

It is certified that error appears in the above-identified patent and that said Letters Patent is hereby corrected as shown below:

Column 13 (cont'd),
Line 3, "vessel." should read -- vessel --.

Signed and Sealed this

Eighth Day of February, 2005

JON W. DUDAS
*Director of the United States Patent and Trademark Office*